US012623278B2

(12) United States Patent
Baumgartner et al.

(10) Patent No.: US 12,623,278 B2
(45) Date of Patent: May 12, 2026

(54) METHOD FOR PRODUCING A MICROALLOYED STEEL, A MICROALLOYED STEEL PRODUCED USING THE METHOD, AND A COMBINED CASTING/ROLLING INSTALLATION

(71) Applicant: Primetals Technologies Austria GmbH, Linz (AT)

(72) Inventors: Kerstin Baumgartner, Wartberg ob der Aist (AT); Simon Grosseiber, Leonding (AT); Thomas Lengauer, Weißkirchen a.d. Traun (AT); Gero Schwarz, Attnang (AT)

(73) Assignee: Primetals Technologies Austria GmbH (AT)

( * ) Notice: Subject to any disclaimer, the term of this patent is extended or adjusted under 35 U.S.C. 154(b) by 40 days.

(21) Appl. No.: 18/568,741

(22) PCT Filed: May 25, 2022

(86) PCT No.: PCT/EP2022/064188
§ 371 (c)(1),
(2) Date: Dec. 8, 2023

(87) PCT Pub. No.: WO2022/258376
PCT Pub. Date: Dec. 15, 2022

(65) Prior Publication Data

US 2024/0269734 A1 Aug. 15, 2024

(30) Foreign Application Priority Data

Jun. 9, 2021 (EP) ..... 21178473

(51) Int. Cl.

| | |
|---|---|
| ***B22D 11/00*** | (2006.01) |
| ***B22D 11/04*** | (2006.01) |
| ***B22D 11/12*** | (2006.01) |
| ***B22D 11/124*** | (2006.01) |
| ***B22D 11/22*** | (2006.01) |
| ***C21D 1/667*** | (2006.01) |
| ***C21D 8/021*** | (2026.01) |
| ***C21D 8/0221*** | (2026.01) |
| ***C21D 9/46*** | (2006.01) |
| ***C21D 9/573*** | (2006.01) |
| ***C21D 11/00*** | (2006.01) |
| ***C22C 38/00*** | (2006.01) |
| ***C22C 38/02*** | (2006.01) |
| ***C22C 38/04*** | (2006.01) |
| ***C22C 38/16*** | (2006.01) |

(Continued)

(52) U.S. Cl.
CPC ..... *B22D 11/001* (2013.01); *B22D 11/0408* (2013.01); *B22D 11/1206* (2013.01); *B22D 11/124* (2013.01); *B22D 11/225* (2013.01); *C21D 1/667* (2013.01); *C21D 8/0215* (2013.01); *C21D 8/0226* (2013.01); *C21D 9/46* (2013.01); *C21D 9/573* (2013.01); *C21D 11/005* (2013.01); *C22C 38/001* (2013.01); *C22C 38/02* (2013.01); *C22C 38/04* (2013.01); *C22C 38/16* (2013.01); *C22C 38/22* (2013.01); *C22C 38/24* (2013.01); *C22C 38/26* (2013.01); *C22C 38/28* (2013.01); *C22C 38/44* (2013.01); *C22C 38/46* (2013.01); *C22C 38/48* (2013.01); *C22C 38/50* (2013.01); *B21B 1/463* (2013.01); *C21D 1/42* (2013.01); *C21D 9/60* (2013.01); *C21D 2211/004* (2013.01); *C21D 2261/00* (2013.01)

(58) Field of Classification Search
CPC ..... C21D 9/46; B22D 11/001
See application file for complete search history.

(56) References Cited

U.S. PATENT DOCUMENTS 7,159,433 B2 1/2007 Seidel
9,144,839 B2 9/2015 Linzer et al.
(Continued)

FOREIGN PATENT DOCUMENTS

AT 512399 B1 8/2013
CN 102051527 A 5/2011
(Continued)

OTHER PUBLICATIONS

International Search Report mailed Aug. 22, 2022 in corresponding PCT International Application No. PCT/EP2022/064188.
(Continued)

*Primary Examiner* — Jophy S. Koshy
(74) *Attorney, Agent, or Firm* — OSTROLENK FABER LLP

(57) ABSTRACT

A process that produces a microalloyed steel in an integrated casting-rolling plant having a continuous casting machine with a mold, a single- or multi-stand prerolling train, a finish-rolling train having a first stand group with at least one first finish-rolling stand and a second stand group having at least one stand cooler. A metallic melt is cast in the mold to obtain a partly solidified thin-slab strand, which is supported, deflected and cooled. The solidified thin-slab strand is rolled by the prerolling train to obtain a prerolled strip that is finish-rolled in the first stand group to obtain the finish-rolled strip, which is fed to the second stand group and force-cooled in the second stand group, the finish-rolled strip having a thickness that results in a cooling rate of the core of the finish-rolled strip in the second stand group greater than 20° C./s and less than 200° C./s.

15 Claims, 5 Drawing Sheets

(51) Int. Cl.

| | |
|---|---|
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| *B21B 1/46* | (2006.01) |
| *C21D 1/42* | (2006.01) |
| *C21D 9/60* | (2006.01) |

(56) References Cited

U.S. PATENT DOCUMENTS

| | | | | |
|---|---|---|---|---|
| 10,071,416 | B2 | 9/2018 | Williams et al. | |
| 11,712,725 | B2 | 8/2023 | Lengauer et al. | |
| 2014/0072824 | A1* | 3/2014 | Linzer | F16L 9/02 164/460 |
| 2016/0151814 | A1 | 6/2016 | Fischer et al. | |

FOREIGN PATENT DOCUMENTS

| | | | |
|---|---|---|---|
| DE | 10131369 | A1 | 1/2003 |
| EP | 1038978 | A1 | 9/2000 |
| EP | 2398929 | A1 | 12/2011 |
| EP | 3434383 | A1 | 1/2019 |
| JP | 2005296973 | A | 10/2005 |

OTHER PUBLICATIONS

Venturini, Roberto et al: "Arvedi ESP Technology—The Hot Rolling of HS and AHS Thin Gauge Steel Strips"; Materials Science Forum, vol. 854, May 17, 2016; pp. 42-47; XP055862821; DOI: 10.4028; www.scientific.net/MSF.854.42.

Wang Xue-Giang et al; "Microstructural Evolution and Strengthening Mechanism of X65 Pipeline Steel Processed by Ultra-fast Cooling"; Journal of Northeastern University; vol. 40; No. 3; Mar. 1, 2019; pp. 334-338, XP009531477; ISSN: 1005-3026, DOI: 10.12068/j.issn.1005-3026.2019.03.006.

* cited by examiner

METHOD FOR PRODUCING A MICROALLOYED STEEL, A MICROALLOYED STEEL PRODUCED USING THE METHOD, AND A COMBINED CASTING/ROLLING INSTALLATION

CROSS-REFERENCE TO RELATED APPLICATIONS

The present application is a national stage application of PCT application PCT/EP2022/064188, filed May 25, 2022, which claims priority to the European patent application, EP21178473, Jun. 9, 2021, the contents of which are incorporated by this reference.

FIELD OF INVENTION

The invention relates to a process for producing a microalloyed steel according to claim 1, to a microalloyed steel according to claim 12, and to an integrated casting-rolling plant according to claim 14.

BACKGROUND

WO 2019/020492 A1 discloses a rolling stand having a stand cooler for cooling of a steel strip.

US 2016/151814 A1 discloses a plant and a process for hot rolling of a steel strip.

EP 2 398 929 A1 discloses a high-strength and thin cast strip product and a production process therefor.

"Microstructural Evolution and Strengthening Mechanism of X65 Pipeline Steel Processed by Ultra-fast Cooling", published in the Journal of Northeastern University (Natural Science) vol. 40, no. 3, 1 Mar. 2019, pages 334-338, XP009531477, ISSN 1005-3026, discloses a process for producing X65 pipeline steel.

Moreover, WO 2020/126473 A1 discloses cooling of a metal strip in a rolling stand.

AT 512 399 B1 discloses a process for producing a microalloyed piping steel in an integrated casting-rolling plant.

SUMMARY

It is an object of the invention to provide an improved process for producing a microalloyed steel in an integrated casting-rolling plant, an improved microalloyed steel and an improved integrated casting-rolling plant.

This object is achieved by a process according to claim 1, by a microalloyed steel, especially a microalloyed piping steel, according to claim 12, and by an integrated casting-rolling plant according to claim 14. Advantageous embodiments are specified in the dependent claims.

It has been recognized that an improved process for producing a microalloyed steel in an integrated casting-rolling plant can be provided in that the integrated casting-rolling plant has a continuous casting machine with a mold, a single- or multi-stand prerolling train, a finish-rolling train having a first stand group with at least one first finish-rolling stand and a second stand group having at least one stand cooler. A metallic melt is cast in the mold to give a partly solidified thin-slab strand.

In this application, strand-cast strands with a thickness of ≤150 mm are referred to as thin-slab strands. The partly solidified thin-slab strand is supported, deflected and cooled. The thin-slab strand is rolled in the prerolling train to give a prerolled strip. The first stand group of the finish-rolling train finish-rolls the prerolled strip to give the finish-rolled strip. Immediately after the finish rolling, the finish-rolled strip is fed to the second stand group and the finish-rolled strip is force-cooled in the second stand group with retention of a thickness of the finish-rolled strip in such a way that a cooling rate of a core of the finish-rolled strip in the second stand group is greater than 20° C./s and less than 200° C./s.

This configuration has the advantage that—preferably in continuous operation—the microalloyed steel can be produced in a simple manner. In particular, it is thus also possible, for example, with a metallic melt containing 10% less microalloy elements (for example titanium, niobium and/or vanadium), corresponding, for example, to an X60 to X120 steel according to standard API 5L/IS03183:2007, to produce a microalloyed steel that meets the mechanical demands for the steel qualities according to the standard cited. By the method, it is thus possible to produce the microalloyed steel in a particularly simple and inexpensive manner.

In continuous operation of the integrated casting-rolling plant, a continuously produced thin-slab strand is prerolled and finish-rolled in uncut form, and the microalloyed steel is cut to bundle length for the first time after passing through the cooling zone.

In a further embodiment, the second stand group has a second finish-rolling stand, wherein the second finish-rolling stand, in a preparation step prior to casting of the metallic melt, is converted to the stand cooler by removing at least one working roll of the second finish-rolling stand and inserting at least one cooling beam into the second finish-rolling stand. In this way, it is possible to convert the integrated casting-rolling plant in a particularly simple manner.

In a further embodiment, a third surface temperature with which the finish-rolled strip leaves the second stand group is ascertained. The forced cooling in the second stand group is controlled by open-loop/closed-loop control depending on the third surface temperature and a third target temperature in such a way that the third surface temperature corresponds essentially to the third target temperature. This third target temperature is less than a ferrite-perlite transformation temperature, preferably less than a bainite start temperature, especially less than a martensite start temperature. This configuration has the advantage that it is possible to produce a particularly inexpensive and mechanically high-quality microalloyed steel having a particularly low level of microalloy elements.

In a further embodiment, a second surface temperature with which the finish-rolled strip leaves the first stand group is ascertained. The second surface temperature is also taken into account in controlling the forced cooling of the finish-rolled strip in the second stand group. In this way, it is possible to particularly accurately adjust the cooling rate of the core of the finish-rolled strip by means of the forced cooling.

In a further embodiment, the cooling rate of the core of the finish-rolled strip is 20° C./s to 80° C./s, especially 45° C./s to 55° C./s. It is advantageous when the cooling is continuous. This ensures that a high-strength, for example bainitic and/or martensitic, microalloyed steel can be produced.

In a further embodiment, the core of the finish-rolled strip is transported with a first exit temperature of 830° C. to 950° C., especially of 880° C. to 920° C., into the second stand group of the finish-rolling train. On exit of the finish-rolled strip from the second stand group, the core of the finish-rolled strip has a second exit temperature of less than 700° C., especially 350° C. to 700° C., preferably of 400° C. to 460° C.

In a further embodiment, the core of the finish-rolled strip is cooled, preferably continuously, from the first exit temperature to the second exit temperature within a time interval of 2 seconds to 40 seconds. This makes it possible to avoid unwanted changes in microstructure as a result of the continuous cooling in the finish-rolled strip.

In a further embodiment, within a time interval of 1 second to 15 seconds after the finish-rolling of the finish-rolled strip in the first stand group, the finish-rolled strip enters the second stand group. As a result of the short time interval, the finish-rolled strip is cooled down from a particularly high first exit temperature. Moreover, unwanted cooling of the finish-rolled strip between the first stand group and the second stand group is kept particularly low.

In a further embodiment, the integrated casting-rolling plant has a cooling zone downstream of the finish-rolling train based on a conveying direction of the finish-rolled strip and a winding device downstream of the cooling zone. Forced cooling of the finish-rolled strip in the cooling zone is deactivated and the finish-rolled strip is transported through the cooling zone from the second stand group to the winding device. In this way, it is possible to dry off the finish-rolled strip in the cooling train, such that the finish-rolled strip is wound up dry to give a coil. Moreover, wear to the cooling train is reduced and hence maintenance work for the cooling zone is minimized.

In a further embodiment, a grain size of the prerolled strip on leaving the prerolling train is 10 μm to 30 μm. The grain size of the prerolled strip between the prerolling train and entry into the first stand group grows to 20 μm to 60 μm, or the grain size is maintained. The grain size of the finish-rolled strip on rolling in the first stand group is reduced to 2 μm to 20 μm. In particular, the microstructure has a "pancake structure" when the finish-rolled strip exits from the first stand group. The grain size can be determined in the cooled prerolled strip 110 and/or cooled finish-rolled strip 145 in a cross section at the normal angle to conveying direction, for example by light microscopy and, for example, according to ISO643 in a middle (both in terms of width and thickness) of the respective strip. On the basis of the grain size measured, the grain size of the prerolled strip between the prerolling train and the finish-rolling train and/or of the finish-rolled strip can be ascertained, for example, by means of a mathematical model. An illustrative mathematical model is known, for example, from ISIJ International, vol. 32 (1992), no. 12, pages 1329 to 1338, published under the title "A Mathematical Model to Predict the Mechanical Properties of Hot Rolled C—Mn and Microalloyed Steels".

In a further embodiment, a thickness of the prerolled strip on entry into the first stand group is 40 mm to 62 mm, especially 45 mm. The first stand group reduces the thickness of the prerolled strip to 10 mm to 25 mm, especially 16 mm to 20 mm. This thickness is suitable in particular for production of pipes from the microalloyed steel.

In a further embodiment, the metallic melt for an X60 or an X70 steel has a chemical composition in percent by weight of C 0.025-0.05%; Si 0.1-0.3%; Mn 0.07-1.5%, Cr<0.15%; Mo<0.2%; Nb 0.02-0.08%; Ti<0.05%; V<0.08%; N<0.008%; balance: Fe and unavoidable impurities. By comparison with AT 512 399 B1, for example, the process lowers the limits on carbon, silicon and chromium. Molybdenum can be added in order to increase strength.

The metallic melt for X80 to X120 steels, especially for X90 to X120 steels, preferably has a chemical composition in percent by weight of C 0.025-0.09%; Si 0.1-0.3%; Mn 0.07-2.0%, Cr<0.5%; Mo<0.5%; Nb 0.02-0.08%; Ti<0.05%; V<0.08%; Ni<0.5%; Cu<0.4%; N<0.01%; balance: Fe and unavoidable impurities.

An improved and inexpensive microalloyed steel, especially microalloyed piping steel having a thickness of 10 mm to 25 mm, especially of 16 mm to 20 mm, can be produced by the process described above. The microalloyed steel for an X60 or an X70 steel preferably has a chemical composition in percent by weight of C 0.025-0.05%; Si 0.1-0.3%; Mn 0.07-1.5%, Cr<0.15%; Mo<0.2%; Nb 0.02-0.08%; Ti<0.05%; V<0.08%; N<0.008%; balance: Fe and unavoidable impurities. The microalloyed steel for X80 to X120 steels preferably has a chemical composition in percent by weight of C 0.025-0.09%; Si 0.1-0.3%; Mn 0.07-2.0%, Cr<0.5%; Mo<0.5%; Nb 0.02-0.08%; Ti<0.05%; V<0.08%; Ni<0.5%; Cu<0.4%; N<0.01%; balance: Fe and unavoidable impurities.

The microalloyed steel advantageously has at least one of the following precipitates at room temperature: Ti(C,N), Nb(C,N) V(C,N) TiC, TiN, Ti(C,N), (Nb, Ti)C, (Nb, Ti)N, (Nb, Ti)(C,N), NbC, NbN, VC, VN, V(C,N), (Nb,Ti,V)(C,N), (Nb,V)C, (Ti,V)C, (Nb,V)(C,N), (Ti,V)(C,N), (Nb,V)N, (Ti,V)N, (Nb,Ti,V)C, (Nb,Ti,V)N. A precipitate density of the precipitates is $10^{20}$-$10^{23}$ 1/m$^3$, where the precipitates have an average size of 1 nm to 15 nm. Preferably, the precipitate density and/or the average size can be determined by transmission electron microscopy (TEM), where a precipitate size for determination of the average size of the precipitates should preferably be determined transverse to a conveying direction of the finish-rolled strip and at right angles to a cross section of the finish-rolled strip.

It has been recognized that an improved integrated casting-rolling plant for production of a microalloyed steel can be provided in that the integrated casting-rolling plant has a continuous casting machine with a mold, a single- or multi-stand prerolling train and a finish-rolling train having at least a first stand group and a second stand group. A metallic melt is castable in the mold to give a partly solidified thin-slab strand, and the prerolling train is feedable with the thin-slab strand.

The prerolling train is designed to roll the fully solidified thin-slab strand to a prerolled strip, with the prerolled strip being feedable to the finish-rolling train. The first stand group is designed to finish-roll the prerolled strip to a finish-rolled strip. Based on a conveying direction of the finish-rolled strip, the second stand group is downstream of the first stand group and has at least one stand cooler. The second stand group is designed, with retention of a thickness of the finish-rolled strip, to force-cool the finish-rolled strip in such a way that a cooling rate of a core of the finish-rolled strip in the second stand group is greater than 20° C./s and less than 200° C./s. This makes it possible to use, in a simple manner, an integrated casting-rolling plant that works, for example, in continuous operation and typically produces conventional finished steel strips to produce finish-rolled strips with microalloyed steel, especially with microalloyed piping steel. This allows the integrated casting-rolling plant to be utilized flexibly in order to produce thin sheets having a thickness of 0.8 mm to 2.5 mm and to produce the finish-rolled strip from the microalloyed steel with the abovementioned thickness of 8 mm to 25 mm.

In a further embodiment, the integrated casting-rolling plant has a cooling zone downstream of the second stand group based on the conveying direction of the finish-rolled strip and a winding device downstream of the cooling zone. In the case of forced cooling of the finish-rolled strip in the second stand group, forced cooling of the finish-rolled strip in the cooling zone is deactivated. The cooling zone is designed exclusively to transport the finish-rolled strip to the winding device and preferably to dry the finish-rolled strip. This configuration has the advantage that the integrated casting-rolling plant can be operated in a particularly energy-efficient manner. In addition, the finish-rolled strip can be wound up dry, such that corrosion to the finish-rolled strip is avoided.

In a further embodiment, the integrated casting-rolling plant has a third temperature measurement device and a control unit, where the third temperature measurement device and the second stand group have a data connection to the control unit. The third temperature measurement device, based on the conveying direction of the finish-rolled strip, is preferably disposed between the second stand group and the cooling zone and is designed to ascertain a third surface temperature of the finish-rolled strip. The control unit is designed, on the basis of the ascertained third surface temperature of the finish-rolled strip and a predefined third target temperature, to control the forced cooling of the second stand group. This configuration has the advantage that a closed-loop control circuit can be provided in order to control the cooling of the finish-rolled strip in the second stand group.

BRIEF DESCRIPTION OF THE FIGURES

The invention is more particularly elucidated below with reference to the figures. The figures show.

DETAILED DESCRIPTION

Figure 1:
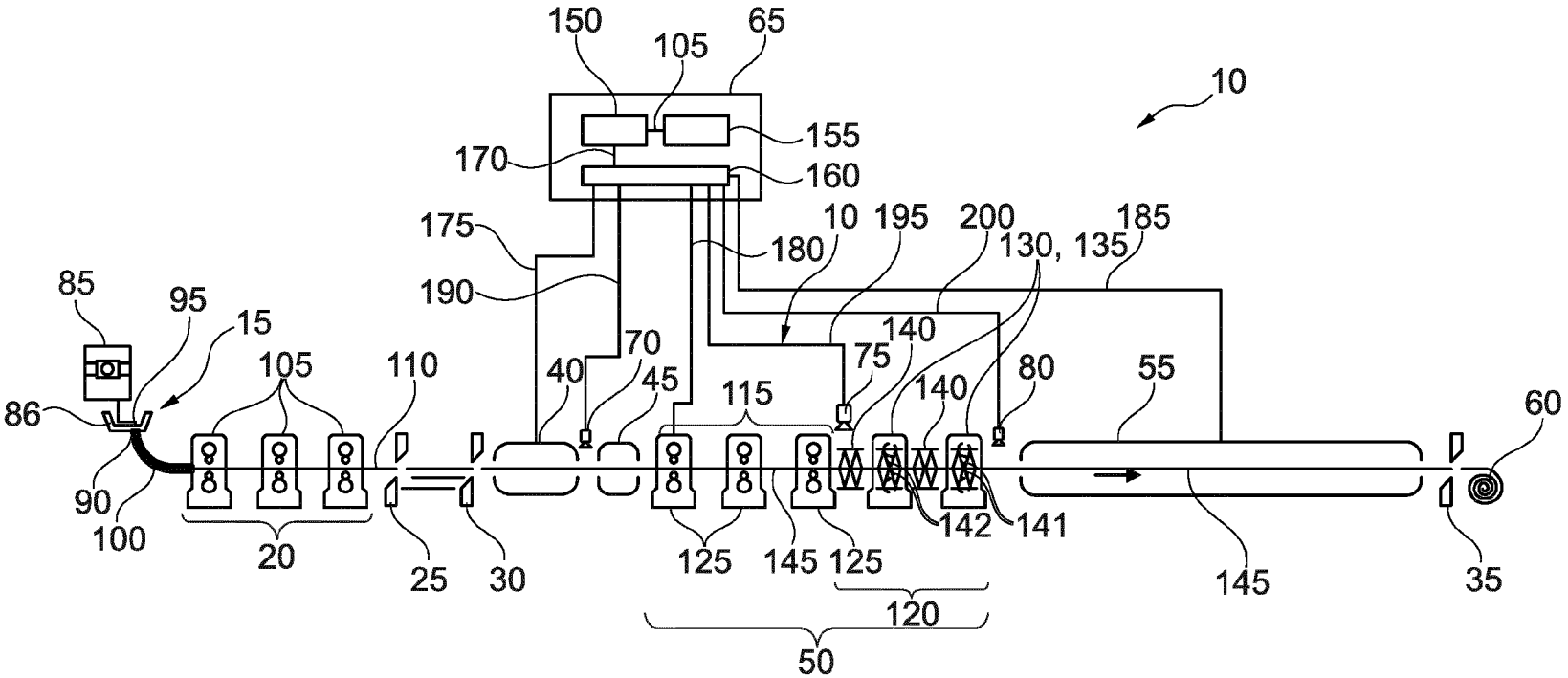
FIG. 1 a schematic diagram of an integrated casting-rolling plant in a first embodiment.

FIG. 1 shows a schematic diagram of an integrated casting-rolling plant 10 in a first embodiment.

The integrated casting-rolling plant 10 has, for example, a continuous casting machine 15, a prerolling train 20, a first to third separating device 25, 30, 35, an intermediate heater 40, preferably a descaler 45, a finish-rolling train 50, a cooling zone 55, a winding device 60 and a control unit 65. In addition, the integrated casting-rolling plant 10 may have a first to third temperature measurement device 70, 75, 80, for example a pyrometer.

The continuous casting machine 15 is designed by way of example as a bow-type continuous casting machine. The continuous casting machine 15 has a ladle 85, a distributor 86 and a mold 90. In operation of the integrated casting-rolling plant 10, the distributor 86 is filled with a metallic melt 95 using the ladle 85. The metallic melt 95 can be produced, for example, by means of a converter, for example in a Linz-Donawitz process. The metallic melt 95 is, for example, a steel melt. The metallic melt 95 flows from the distributor 86 into the mold 90. In the mold 90, the metallic melt 95 is cast to a thin-slab strand 100. The partly solidified thin-slab strand 100 is drawn out of the mold 90 and deflected in an arc into a horizontal, while being supported and solidified, by the configuration of the continuous casting machine 15 as a bow-type continuous casting machine. The thin-slab strand 100 is conveyed away from the mold 90 in conveying direction.

It is particularly advantageous here when the continuous casting machine 15 casts a continuous thin-slab strand 100 and feeds it to a prerolling train 20 downstream in conveying direction of the thin-slab strand 100. In this embodiment, the prerolling train 20 follows on directly from the continuous casting machine 15.

The prerolling train 20 may have one or more prerolling stands 105 arranged successively in the conveying direction of the thin-slab strand 100. The number of prerolling stands 105 is choosable essentially freely and is dependent on a format of the thin-slab strand 100 and on a desired thickness of the prerolled strip 110. In this embodiment, three prerolling stands 105 are provided for the prerolling train 20 shown in FIG. 1 by way of example. The prerolling train 20 is designed to roll the thin-slab strand 100, which is hot when fed into the prerolling train 20, to a prerolled strip 110.

The first and second separating devices 25, 30 are downstream of the prerolling train 20 based on the conveying direction of the prerolled strip 110. The second separating device 30 is spaced apart from the prerolling train 20, based on the conveying direction of the prerolled strip 110. It is possible for an outward conveying device to be disposed between the first separating device 25 and the second separating device 30. It is also possible to dispense with the second separating device 30. The first and/or second separating devices 25, 30 may be designed, for example, as drum shears or pendulum shears.

In the production of the microalloyed steel/microalloyed piping steel, the integrated casting-rolling plant can be operated in continuous operation, i.e. in that the thin-slab strand enters the prerolling train 105 in uncut form, the prerolled strip passes through the first and/or second separating devices in uncut form, and the prerolled strip in uncut form is finish-rolled in the finish-rolling train 50, and only after passing through the cooling zone 55 is cut to bundle length.

Based on the conveying direction of the prerolled strip 110, in this embodiment, the second separating device 30 is followed by the intermediate heater 40 by way of example. The intermediate heater 40 is designed, for example, as an induction furnace. A different configuration of the intermediate heater 40 would also be conceivable. The intermediate heater 40 is upstream of the finish-rolling train 50 and the descaler 45 based on the conveying direction of the prerolled strip 110. The descaler 45 is directly upstream of the finish-rolling train 50 and downstream of the intermediate heater 40.

The finish-rolling train 50, in this embodiment, has a first stand group 115 and a second stand group 120. The first stand group 115 is upstream of the second stand group 120 based on the conveying direction of the prerolled strip 110. The first stand group 115 may have, for example, two to four first finish-rolling stands 125. The first finish-rolling stands 125 are arranged in series based on the conveying direction of the prerolled strip 110. The first stand group 115 follows on directly from the descaler 45, if the descaler 45 is provided, based on the conveying direction of the prerolled strip 110. If the descaler 45 is dispensed with, the first stand group 115 follows directly on from the intermediate heater 40.

The second stand group 120 has at least one, preferably two, second finish-rolling stand (s) 130, where the first finish-rolling stand 125 and the second finish-rolling stand 130 may be of identical construction. In this embodiment, however, it is at least the case that, in addition, the second finish-rolling stand 130 has a means of conversion to a stand cooler 135. In this embodiment, the two second finish-rolling stands 130 have each been converted to one stand cooler 135. In the function of the stand cooler 135, the second finish-rolling stand 130 no longer performs a rolling process.

In addition, the second stand group 120 may have at least one intermediate cooler 140. The intermediate cooler 140 may be disposed in each case between two finish-rolling stands 125, 130. In this embodiment, the second stand group 120 has, by way of example, two intermediate coolers 140, where a first of the two intermediate coolers 140 is disposed by way of example between the last first finish-rolling stand 125 of the first stand group 115 in conveying direction and the foremost second finish-rolling stand 130 in conveying direction. It is also possible for a further intermediate cooler 140 to be disposed between the two second finish-rolling stands 130. It is also possible to dispense with the intermediate coolers 140 or to provide just one of the two intermediate coolers 140.

As already elucidated above, in this embodiment, the second finish-rolling stand 130 has been converted to the stand cooler 135. The means of conversion may be implemented in that the second finish-rolling stand 130 has a changeover device (not shown). In one configuration of the second finish-rolling stand 130 as second rolling stand, the changeover device secures at least one insert and an upper and/or lower working roll 141, 142 (shown by dashes in FIG. 1) in the second finish-rolling stand 130. In the configuration as second rolling stand with at least the upper and/or lower working roll 141, 142, the second finish-rolling stand 130 is designed to roll the prerolled strip 110.

In the configuration of the second finish-rolling stand 130 as stand cooler 135, the changeover device secures means of cooling a finish-rolled strip 145 rather than the insert and the lower and/or upper working rolls 141, 142. The insert and the upper and/or lower working rolls 141, 142 have been withdrawn. The configuration of the second finish-rolling stand 130 as stand cooler 135 and the envisaged means of cooling the finish-rolled strip 145 are discussed hereinafter. The changeover device allows the second finish-rolling stand 130 to be converted rapidly and easily between the second rolling stand for rolling the prerolled strip 110 and the stand cooler 135.

The stand cooler 135 and the intermediate cooler 140 each have at least one cooling beam as means of cooling. The cooling beams of the stand cooler 135 and/or of the intermediate cooler 140 are preferably respectively disposed both on the top side and on the bottom side relative to the finish-rolled strip 145, in order to particularly rapidly and effectively cool the finish-rolled strip 145 on both sides. In the stand cooler 135, the cooling beam is secured by means of the changeover device in place of the upper and/or lower working roll 141, 142.

It is possible by virtue of the configuration shown in FIG. 1 to provide a total of 16 cooling beams, for example, by means of two intermediate coolers 140 and two stand coolers 135. It is possible here, for example, for each stand cooler 135 to have two cooling beams disposed on the top side and two cooling beams disposed on the bottom side relative to the finish-rolled strip 145. It is pointed out that this configuration is an illustrative configuration of the second stand group 120. It will be appreciated that it would also be conceivable to design the second stand group 120 differently. For example, it is possible to dispense with at least one of the intermediate coolers 140. A different arrangement of the intermediate cooler (s) 140 would also be conceivable. The arrangement and/or number of cooling beams is also illustrative. For instance, the number of cooling beams, in one development, may be increased or reduced. It is also conceivable that the cooling beams are disposed only on the top side or bottom side of the finish-rolled strip 145.

In this embodiment, the upper and/or lower working rolls 141, 142 are detached in order to provide sufficient build space for the cooling beams in the second finish-rolling stand 130 that has been converted to the stand cooler 135. In one development, it would also be possible for just the upper or lower working roll 141, 142 to be removed.

In operation of the integrated casting-rolling plant 10, the first finish-rolling stands 125 finish-roll the prerolled strip 110 fed into the first stand group 115 to the finish-rolled strip 145. The cooling zone 55 is downstream of the finish-rolling train 50 based on a conveying direction of the finish-rolled strip 145. In conveying direction of the finish-rolled strip 145, the third separating device 35 is downstream of the cooling zone 55. The third separating device 35 is disposed here between the winding device 60 and the cooling zone 55. The third separating device 35 may be designed, for example, as drum shears or pendulum shears.

The control unit 65 comprises a control device 150, a data storage medium 155 and an interface 160. The data storage medium 155 has a data connection to the control device 150 by means of a first data connection 165. The interface 160 likewise has a data connection to the control device 150 by means of a second data connection 170.

The data storage medium 155 stores a predefined first target temperature, a predefined second target temperature and a predefined third target temperature TS3. The data storage medium 155 also stores a process for producing the microalloyed steel, on the basis of which the control device 150 controls the components of the integrated casting-rolling plant 10.

The interface 160 has a data connection to the intermediate heater 40 by means of a third data connection 175. A fourth data connection 180 provides a data connection of the finish-rolling train 50 to the interface 160. A fifth data connection 185 connects the cooling zone 55 to the interface 160. The temperature measurement device 70, 75, 80 has a respective data connection to the interface 160 via an assigned sixth to eighth data connection 190, 195, 200. In addition, further data connections (not shown in FIG. 1) to the further components of the integrated casting-rolling plant 10 may be additionally provided, such that exchange of information between the different components of the integrated casting-rolling plant 10 and the control unit 65 is possible. The third to eighth data connections 175, 180, 185, 190, 195, 200 may, for example, be part of an industrial network.

Figure 2:
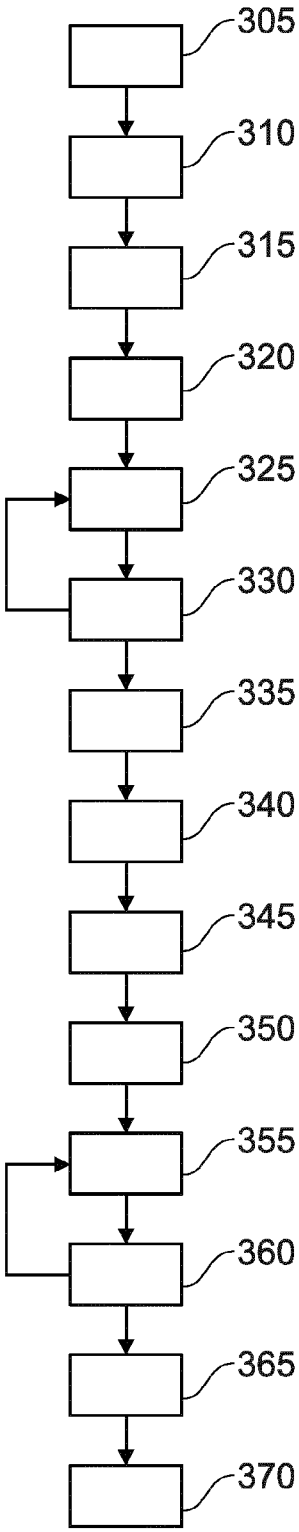
FIG. 2 a flow diagram of a process for operating the integrated casting-rolling plant shown in FIG. 1.

FIG. 2 shows a flow diagram of a process for operating the integrated casting-rolling plant 10 shown in FIG. 1.

Before the process described hereinafter is performed, the second finish-rolling stands 130 or the second finish-rolling stand 130 of the second stand group 120 are/is converted to the configuration as stand cooler 135 in a preparatory step. For this purpose, the upper and/or lower working rolls 141, 142 may be removed from the second finish-rolling stand 130 and replaced by the cooling beams by opening the changeover device. Moreover, the cooling beam may be aligned such that it is angled directly in the direction of a passage through which the finish-rolled strip 145 is conducted. In the closed state of the changeover device, the cooling beams are secured in the stand cooler 135.

As a result of the preparatory step, the construction of the integrated casting-rolling plant 10 shown in FIG. 1 no longer corresponds to the conventional construction of an integrated casting-rolling plant, but differs from the construction thereof. As a result of the changeover, the integrated casting-rolling plant 10 is no longer suitable for production of a thin finish-rolled strip 145 having a thickness of 0.8 mm to 8 mm. The preparatory step is conducted prior to establishment of the production method for production of the microalloyed steel.

Figure 3:
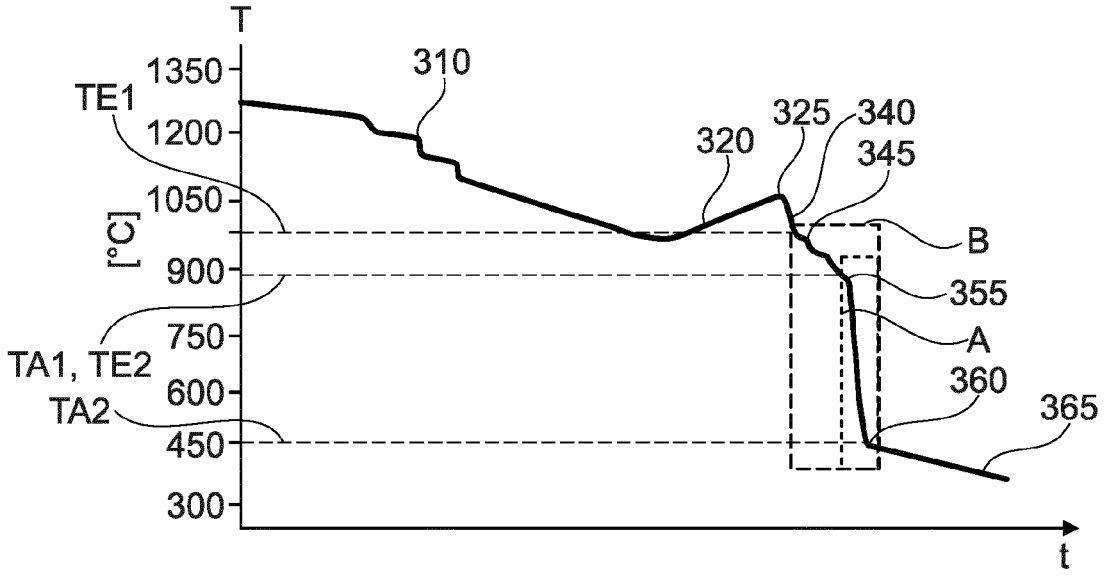
FIG. 3 a first diagram of a core temperature in the production of a finish-rolled strip plotted against time.
Figure 4:
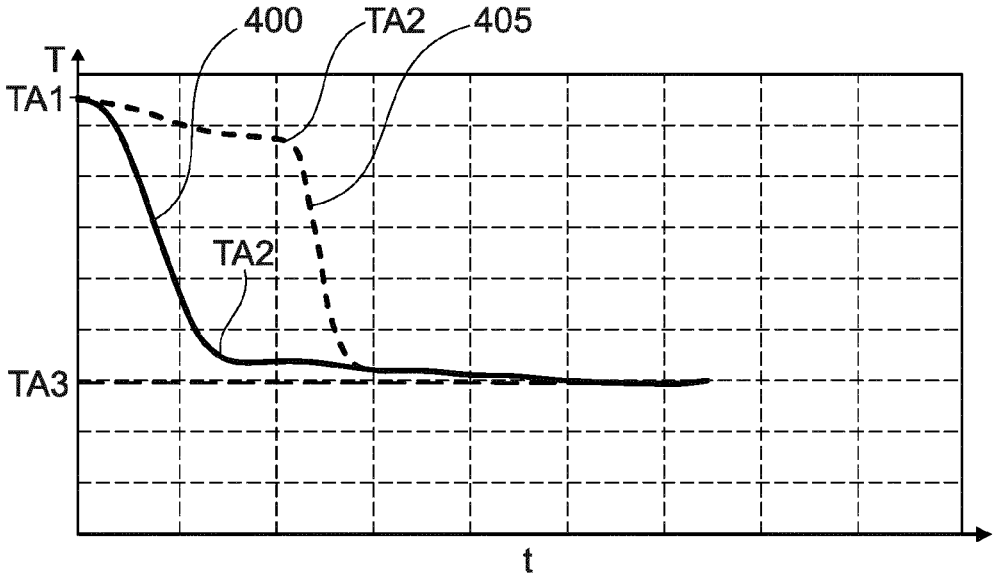
FIG. 4 a first detail A marked in FIG. 3 from the first diagram shown in FIG. 3.
Figure 5:
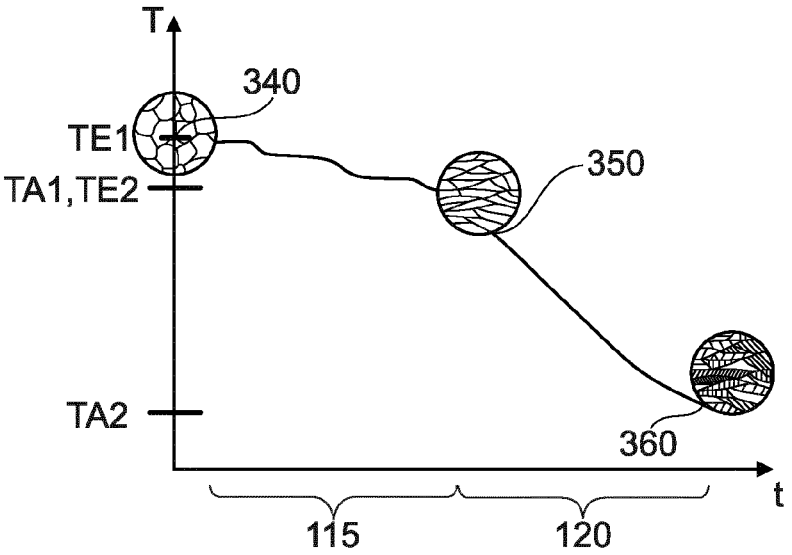
FIG. 5 a second detail B marked in FIG. 3 from the first diagram shown in FIG. 3.
Figure 6:
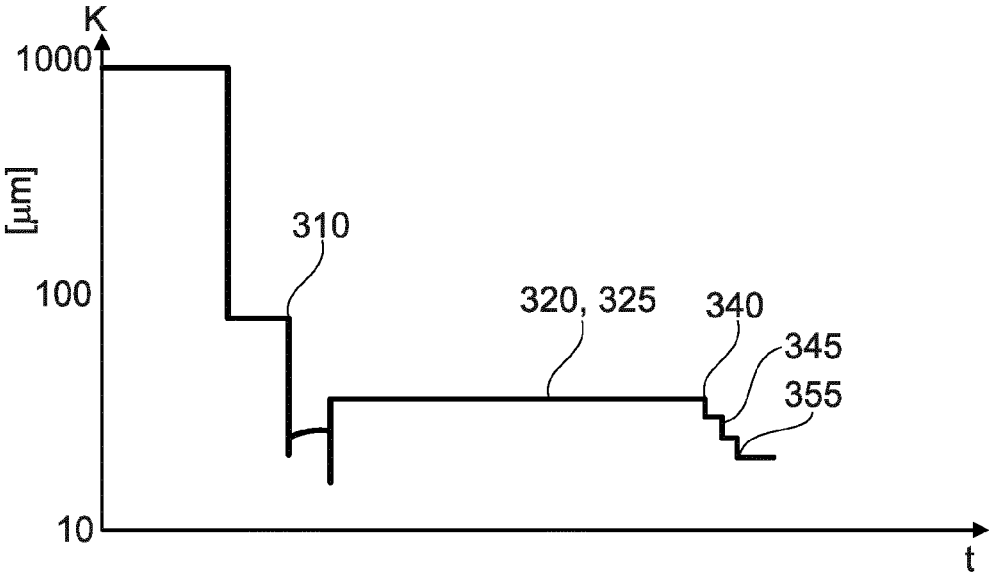
FIG. 6 a second diagram of a progression of a grain size in the production of the finish-rolled strip plotted against time.

FIG. 3 shows a first diagram of a core temperature of a core of the finish-rolled strip 145 in the production of the finish-rolled strip 145 plotted against a time t. FIG. 4 shows a first detail A marked in FIG. 3 from the first diagram shown in FIG. 3. FIG. 5 shows a second detail B marked in FIG. 3 from the first diagram shown in FIG. 3. FIG. 6 shows a second diagram of a progression of a grain size K in the production of the finish-rolled strip 145 plotted against time t. There follows a collective elucidation of FIGS. 2 to 6. In order to mark individual steps in FIGS. 3 to 7, the respective reference numeral of the assigned process step in FIGS. 3 to 7 is specified.

In FIG. 4, a first graph 400 and a second graph 405 are plotted. The first graph 400 shows the temperature progression of the core on performance of the process described hereinafter with regard to FIG. 2. The second graph 405 shows a temperature progression of the core when, by means of the integrated casting-rolling plant 10 shown in FIG. 1 and three rolling finish-rolling stands 125, 130 and the cooling zone 55, the finish-rolled strip 145 with the above-specified thickness of 10 mm to 25 mm is produced.

In operation of the integrated casting-rolling plant 10, in a first process step 305, the mold 90 (shown in FIG. 1) of the continuous casting machine 15 is closed by means of a dummy bar head (not shown in FIG. 1) and sealed by additional sealing material. The ladle 85 is used to introduce the metallic melt 95 into a distributor of the continuous casting machine 15. In order to begin continuous casting, a stopper is removed from a casting tube of the continuous casting machine 15. The metallic melt 95 for an X60 or an X70 steel has a chemical composition in percent by weight of C 0.025-0.05%; Si 0.1-0.3%; Mn 0.07-1.5%, Cr<0.15%; Mo<0.2%; Nb 0.02-0.08%; Ti<0.05%; V<0.08%; N<0.008%; balance: Fe and unavoidable impurities. The metallic melt 95 for X80 to X120 steels may preferably have a chemical composition in percent by weight of C 0.025-0.09%; Si 0.1-0.3%; Mn 0.07-2.0%, Cr<0.5%; Mo<0.5%; Nb 0.02-0.08%; Ti<0.05%; V<0.08%; Ni<0.5%; Cu<0.4%; N<0.01%; balance: Fe and unavoidable impurities. The specification of the steel relates to standard API 5L/IS03183: 2007. The metallic melt 95 may also have a different chemical composition.

The temperatures and process steps specified hereinafter relate to the compositions of the steel that are preferred in the embodiment, in order to produce, by means of the integrated casting-rolling plant 10, a microalloyed steel, especially a microalloyed piping steel having a steel quality X60 to X120, especially X90 to X120, according to standard API 5L/IS03183:2007.

On commencement of continuous casting, the metallic melt 95 flows around the dummy bar head in the mold 90 and solidifies on the dummy bar head through cooling. The dummy bar head is slowly drawn out of the mold 90 of the continuous casting machine 15 in the direction of the prerolling train 20. Downstream of the dummy bar head in conveying direction, the metallic melt 95 in the mold 90 cools at its contact surfaces with the mold 90 and forms a shell of the thin-slab strand 100. The shell surrounds a still-liquid core and retains the liquid core. At the mold outlet, the thin-slab strand 100 may, for example, have a thickness of 100 mm to 150 mm.

In the continuous casting machine 15, the thin-slab strand 100 is deflected and cooled further on the way to the prerolling train 20 such that the thin-slab strand 100 solidifies from the outside inward. In this embodiment, by way of example, the continuous casting machine 15 is configured as a bow-type continuous casting machine, such that the deflection of the thin-slab strand 100 by essentially 90° from the vertical results in feeding of the thin-slab strand 100 essentially horizontally into the prerolling train 20.

In a second process step 310, the thin-slab strand 100, as already elucidated above, is rolled to the prerolled strip 110 by the prerolling stands 105 in the prerolling train 20. On entry into the prerolling train 20, a microstructure of the thin-slab strand 100 has, for instance, a grain size K of about 800 μm to 1000 μm. The thickness is reduced successively at the prerolling stands 105 to, for example, 40 mm to 62 mm, especially 45 mm. Moreover, the microstructure of the thin-slab strand 100 recrystallizes in the course of hot rolling to give the prerolled strip 110, such that the microstructure of the prerolled strip 110, when it is conducted out of the prerolling train 20, has preferably recrystallized fully. The individual hot rolling steps in the prerolling stands 105 homogenize the microstructure of the thin-slab strand 100 toward the prerolled strip 110. The grain size K on leaving the prerolling train may be 10 μm to 30 μm.

A core temperature T of the core of the thin-slab strand 100 on entry into the prerolling train 20 in the case of the abovementioned chemical compositions is about 1300 to 1450° C. In each rolling step in the prerolling train 20, the core temperature of the core is reduced, such that the prerolled strip 110 on exit has a core temperature of about 980 to 1150° C.

In a third process step 315, the prerolled strip 110 is passed through the first and second separating devices 25, 30 without separating off the prerolled strip 110. There is thus merely passage through the first and second separating devices 25, 30. Convection cools the prerolled strip 110 further here, although a protective cover can reduce the cooling. During the transportation of the prerolled strip 110 to the intermediate heater 40 and the associated cooling, the grain size K in the prerolled strip 110 can grow to 20 μm up to 60 μm. It is also possible for the grain size K, especially in the case of the abovementioned chemical compositions of the melt 95, to be maintained and not to grow.

In the fourth process step 320, the control device 150 activates the intermediate heater 40, such that the intermediate heater 40, in the form of an induction furnace, for example, heats the core temperature of the prerolled strip 110 from about 870° C. to 980° C. on entry into the intermediate heater 40 up to about 1050° C. to 1100° C. (cf. FIG. 3). The grain size K can be kept essentially constant in the microstructure in the course of heating (cf. FIG. 6).

In a fifth process step 325, the first temperature measurement device 70, in the form of a first pyrometer for example, ascertains a first surface temperature of the prerolled strip 110 conducted out of the intermediate heater 40. The first temperature measurement device 70 provides a first datum as to the first surface temperature of the prerolled strip 110 between the intermediate heater 40 and the descaler 45 via the sixth data connection 190 of the interface 160, which provides the first datum to the control device 150.

In a sixth process step 330, the control device 150 controls a heating output of the intermediate heater 40 such that the ascertained first surface temperature of the prerolled strip 110 between the intermediate heater 40 and the descaler 45 corresponds essentially to the first target temperature. The control device 150 can repeat the fifth and sixth process steps 325, 330 regularly in a loop at a predefined time interval.

In a seventh process step 335, the control device 150 activates the descaler 45 (if present). The descaler 45 descales the prerolled strip 110. This cools the prerolled strip 110, for example by about 80° C. to 100° C. based on the core of the prerolled strip 110.

At the first entrance temperature TE1, the prerolled strip 110 is transported in an eighth process step 340 to the first stand group 115 of the finish-rolling train 50. The first entrance temperature TE1 based on the core of the prerolled strip 110, with which the prerolled strip 110 enters the first stand group 115 downstream of the descaler 45, may be between 850° C. and 1060° C., especially between 920° C. and 980° C. On entry into the first stand group 115, the microstructure of the prerolled strip 110 is preferably homogeneously austenitic and recrystallized.

In a ninth process step 345, the prerolled strip 110 is finish-rolled to the finish-rolled strip 145, for example by means of three first finish-rolling stands 125. Each rolling step in the first stand group 115 cools the prerolled strip 110 to be rolled to the finish-rolled strip 145 by about 50° C. By means of the three first finish-rolling stands 125, the thickness of the prerolled strip 110 is reduced, for example, from 40 mm to 62 mm, especially 45 mm, down to a thickness of 10 mm to 25 mm, especially to 16 mm to 20 mm.

The three rolling steps in the respective first finish-rolling stands 125 form a "pancake" or a recrystallized austenitic microstructure in the prerolled strip 110 that has been rolled to the finish-rolled strip 145 (cf. FIG. 5). Preferably, after the ninth process step 345, the grain size K on exit from the first stand group 115 is 2 μm to 20 μm. A first exit temperature TA1 of the finish-rolled strip 145 after passing through the first stand group 115 is preferably 830° C. to 950° C. In particular, the first exit temperature TA1 is 880° C. to 920° C. The first exit temperature TAL is based on the core of the finish-rolled strip 145.

The grain size can be determined in the cooled prerolled strip 110 and/or cooled finish-rolled strip 145 in a cross section at right angles to conveying direction, for example by light microscopy in a middle (both in terms of width and thickness) of the respective strip. On the basis of the grain size measured, the grain size K of the prerolled strip 110 between the prerolling train 20 and the finish-rolling train 50 can be ascertained, for example, by means of a mathematical model. An illustrative mathematical model is known, for example, from ISIJ International, vol. 32 (1992), no. 12, pages 1329 to 1338, published under the title "A Mathematical Model to Predict the Mechanical Properties of Hot Rolled C—Mn and Microalloyed Steels".

At the first exit temperature TA1, the finish-rolled strip 145 is transported in a tenth process step 350 further in the direction of the second stand group 120. Because the second stand group 120 follows on directly from the first stand group 115, a period of time from the exit from the first stand group 115 into the second stand group 120 is minimal. In particular, the period of time, for example in the case of a conveying speed of 0.4 m/s to 1 m/s, by virtue of the direct arrangement of the second stand group 120 downstream of the first stand group 115, may be only 1 second to 15 seconds. In particular, the intermediate cooler 140 that follows on from the first stand group 115 may follow on from the first stand group 115 spatially at a distance of a few meters (less than 10 m) down to about 0.5 meter.

By virtue of the spatially small distance between the first stand group 115 and the second stand group 120, the first exit temperature TA1 corresponds essentially to a second entrance temperature TE2 with which the finish-rolled strip 145 enters the second stand group 120.

Moreover, in the tenth process step 350, by means of the second temperature measurement device 75, a second surface temperature of the finish-rolled strip 145 coming from the first stand group 115 is ascertained. The second temperature measurement device 75 provides a second datum in the form of the first exit temperature TA1 to the control device 150 via the seventh data connection 195 and the interface 160. The control device 150 can also take account of the second surface temperature in the control of the intermediate heater 40. The second surface temperature correlates with the first exit temperature TA1, where the second surface temperature varies in its value from the first exit temperature TA1. The intermediate heater 40 is controlled by closed-loop control in such a way that the second surface temperature corresponds essentially to a second target temperature. It is also possible to dispense with the second temperature measurement device 75 and the tenth process step 350.

In an eleventh process step 355, the control device 150 activates the intermediate cooler 140 and the stand cooler 135. The intermediate cooler 140 and the stand cooler 135 spray a cooling medium, for example water, optionally with an additive, onto the finish-rolled strip 145, such that the finish-rolled strip 145 is force-cooled in the second stand group 120. At the same time, the finish-rolled strip 145 is guided through the second stand group 120 while retaining its thickness. There is no further rolling of the finish-rolled strip 145 in which the thickness of the finish-rolled strip 145 is reduced. If one of the working rolls 141, 142 has remained in the stand cooler 135, this can be used to support and/or to transport the finish-rolled strip 145.

By way of example, the conveying rate of the cooling medium is chosen such that, within the second stand group 120, the finish-rolled strip 145 is cooled down from the second entrance temperature TE2 to a second exit temperature TA2 of less than 700° C., especially of 350° C. to 700° C., especially of 400° C. to 460° C., within 2 to 40 seconds. The control device 150 controls the conveying rate of the cooling medium in such a way that a cooling output of the second stand group 120 ensures a cooling rate of the core of the finish-rolled strip 145 of at least 20° C./s to 200° C./s. The cooling rate is preferably 20° C./s to 80° C./s, especially 45° C./s to 55° C./s, where the cooling in the core by means of the second stand group 120 is preferably continuous.

This cooling rate is ensured in this embodiment in that preferably two intermediate coolers 140 and two stand coolers 135 are provided. It is possible here, for example, to apply about 100 $m^3$/h to 300 $m^3$/h of the cooling medium per cooling beam of the stand cooler 135 at a pressure of 2 bar to 4 bar to the finish-rolled strip 145. This ensures that, within the short time taken for the finish-rolled strip 145 to pass through the second stand group 120, the core of the finish-rolled strip 145 is cooled down from the second entrance temperature TE2 of, for example, 870° C. to 910° C. to the second exit temperature TA2, for example 400° C. to 460° C.

Each stand cooler 135 may be designed such that a control valve controllable by the control device 150 is provided for each cooling beam in order to actuate these separately from one another with infinite variability and separately from the respective other cooling beams of the intermediate cooler 140 or of the other stand cooler 135. In this way, infinite controllability of a volume flow rate of the cooling medium between 0% and 100% through the control device 150 is possible for each cooling beam.

By virtue of the rapid and very early cooling of the finish-rolled strip 145 directly downstream of the first stand group 115, it can be ensured that the maximum possible cooling rate is commenced with the high second exit temperature TE2. This avoids cooling of the finish-rolled strip 145 in a mere passage through the second stand group 120 and with deactivated conveying of the cooling medium through the second stand groups 120, and cooling that commences only in the cooling zone 55.

In a twelfth process step 360, the third temperature measurement device 80, in the form of a third pyrometer for example, ascertains a third surface temperature that correlates to the second exit temperature TA2 after the finish-rolled strip 145 has exited from the second stand group 120. The third temperature measurement device 80 provides a third datum as to the third surface temperature via the eighth data connection 200 to the interface 160 and via the interface 160 to the control device 150. The control device 150, in the case of closed-loop control of the volume flow rate of the cooling medium in the second stand group 120 in the eleventh process step 355, can also take account of the datum as to the third surface temperature and control the volume flow rate of the cooling medium by closed-loop control such that the third surface temperature corresponds essentially to the third target temperature TS3. Moreover, when the volume flow rate is under closed-loop control, it is additionally possible to take account of the second surface temperature in order to ensure a uniformly high cooling rate in the second stand group 120. The control device 150 can repeat the eleventh and twelfth process steps 355, 360 regularly in a loop at a predefined time interval.

In a thirteenth process step 365, the finish-rolled strip 145 is transported in the cooled state into the cooling zone 55. In the thirteenth process step 365, the control device 150 deactivates the cooling zone 55 or keeps it in the deactivated state, such that, when the finish-rolled strip 145 passes through the cooling zone 55, no further cooling medium is applied to the finish-rolled strip 145 for further forced cooling of the finish-rolled strip 145. This is unnecessary firstly because of the high cooling output of the second stand group 120; secondly, the convective cooling in the passage through the cooling zone 55 is sufficient for further cooling of the finish-rolled strip 145 from the second exit temperature TA2 to a third exit temperature TA3 below the second exit temperature TA2. In addition, the cooling medium remaining on the finished strip, especially cooling water, dries off in the cooling zone 55. This further cools the finish-rolled strip 145 in the cooling zone 55.

It will be appreciated that it is also possible in the thirteenth process step 365 for the control device 150 to activate the cooling zone 55 in order to force-cool the finish-rolled strip 145 from the second exit temperature TA2 to the third exit temperature TA3.

In a fourteenth process step 370, the finish-rolled strip 145 that has been cooled further in the cooling zone 55 is guided through the third separating device 35 toward the winding device 60. In the winding device 60, the finish-rolled, dried and cooled finish-rolled strip 145 is wound up to a coil. After the coil has been wound up, the control device 150 can activate the third separating device 35, such that the finish-rolled strip 145 conveyed continuously out of the cooling zone 55 is separated from the coil and the coil can be removed. The further finish-rolled strip 145 transported through the cooling zone 55 can be wound up on a new coil.

The above-described integrated casting-rolling plant 10 and the process described in FIG. 2 have the advantage that the mechanical conditions for an X70 to X120 microalloyed steel can be satisfied with the chemical composition, for example with a chemical composition for an X60 steel. The microalloyed steel is especially suitable as microalloyed piping steel for production of pipes, pipelines or pressure tanks. The cooling that follows on directly from the first stand group 115 by means of second finish-rolling stands 130 converted to stand coolers 135 and the intermediate coolers 140 allows particularly good material properties to be ensured in respect of the microalloyed steel. As a result, the microalloyed steel is particularly tough and firm. Moreover, the integrated casting-rolling plant 10 has a particularly exact temperature regime.

Because exclusively the two stand coolers 135 and the second finish-rolling stands 130 have to be converted to stand coolers 135 in order to perform the process described above, provided that no microalloyed steel, especially no microalloyed piping steel, is to be produced, the integrated casting-rolling plant 10 can be operated conventionally with conversion of the stand coolers 135 back to second finish-rolling stands 130 in conventional operation. Moreover, in conventional operation, the intermediate coolers 140 are deactivated and the cooling zone 55 is activated. In conventional operation, for example in order to produce thin sheets having a thickness of 0.8 mm to 8 mm, the finish-rolled strip 145 is then rolled by all five finish-rolling stands 125, 130 and the finish-rolled strip 145 is cooled to the second exit temperature TA2 essentially in the cooling zone 55 rather than in the second stand group 120.

The second graph 405 (cf. FIG. 4) illustrates how the finish-rolled strip 145 cools down gradually from the first exit temperature TA1 down to the second exit temperature TA2. In conventional operation of the integrated casting-rolling plant 10 shown in FIG. 1, the first exit temperature TA1 is about 800° C. to 950° C. Only in the cooling zone 55 is the finish-rolled strip 145 cooled down, and then a core temperature falls rapidly. It is not possible to produce the microalloyed steel producible by the process described in FIG. 2 by cooling down the finish-rolled strip 145 slowly by about 50° C. to 100° C. over a period of time of about 15 to 50 seconds, for instance. In order to produce a desired microalloyed steel having these properties, additional alloying additions are needed in the conventional operation of the integrated casting-rolling plant 10 shown in FIG. 1.

The first graph 400, which shows the temperature progression of the process shown in FIG. 2, illustrates how quickly the core of the finish-rolled strip 145 is cooled down from the first exit temperature TA1 to the second exit temperature TA2. In this way, it is possible by means of a chemical alloy that corresponds to an X60 steel for example to achieve the mechanical properties of a more highly alloyed steel, for example an X70 to X120 steel, at lower cost.

Figure 7:
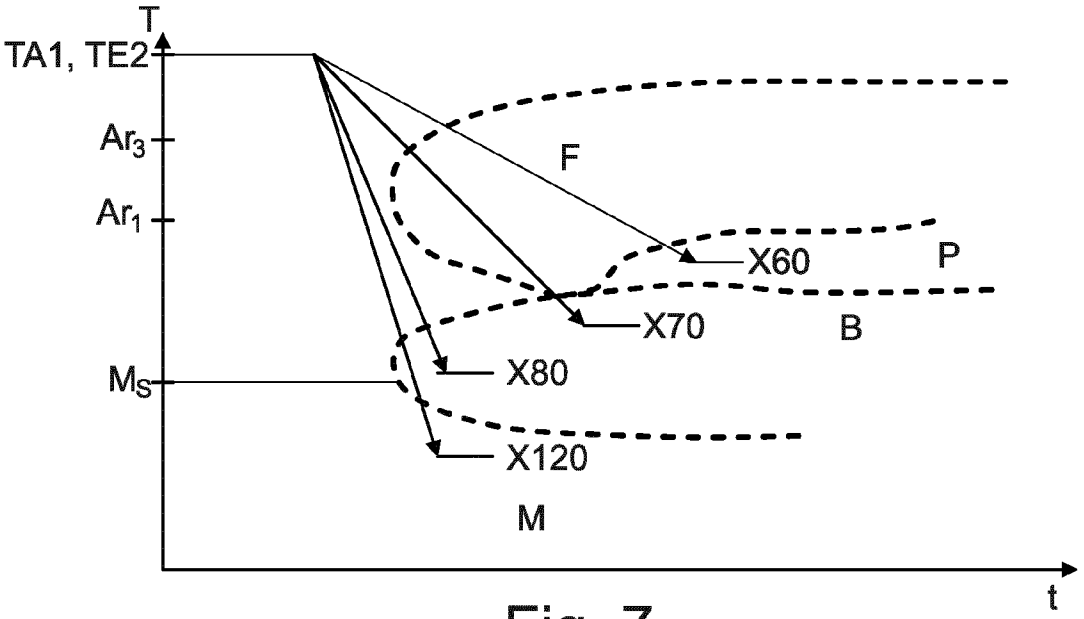
FIG. 7 a TTT diagram for an X60 steel melt.

FIG. 7 shows a schematic TTT diagram for an X60 steel melt.

FIG. 7 gives the third target temperature TS3 as a function of a desired microalloyed steel to be produced. The third target temperature TS3 chosen is at least lower than a ferrite-perlite transformation temperature $Ar_1$, preferably lower than a bainite start temperature, especially lower than a martensite start temperature $M_s$.

Depending on the third target temperature TS3, proceeding from the second entrance temperature TE2/the first exit temperature TA1, the finish-rolled strip 145 can be cooled down in the second stand group 120 in the twelfth process step 360. Depending on the choice of predefined third target temperature TS3, the control device 150 controls the volume flow rate of the cooling medium conducted onto the finish-rolled strip 145 and hence the cooling speed. If the third target temperature TS3 chosen is particularly low, the control device 150 controls the second stand group 120 in such a way that it cools down the finish-rolled strip 145 with a particularly large amount of cooling medium. This has the advantage that, for example by means of the above-specified chemical composition that for example corresponds essentially to an X60 steel, for example, it is possible to produce a microalloyed steel having the mechanical properties of an X120 steel.

If the third target temperature TS3 is set above a martensite start temperature $M_s$, it is possible by means of the abovementioned X60 steel melt 95 to produce a microalloyed steel having the mechanical properties of an X80 steel. It is likewise possible, if the third target temperature TS3 should be set higher than just described, to use the X60 steel melt to produce microalloyed steel having the mechanical properties of an X70 steel. X70 and X80 microalloyed steels each have predominantly a bainitic phase component B, whereas X120 microalloyed steel has essentially a phase component of 25-65% martensite M.

It is likewise possible by the process described in FIG. 2 to produce a typical X60 or X70 microalloyed steel having a perlitic phase component P amounting to 5-50 percent by volume in a simple manner.

The microalloyed steel may have at least one of the following precipitates: Ti(C,N), Nb(C,N) V(C,N) TiC, TiN, Ti(C,N), (Nb, Ti) C, (Nb, Ti) N, (Nb, Ti) (C,N), NbC, NbN, VC, VN, V(C,N), (Nb,Ti,V) (C,N), (Nb,V) C, (Ti,V)C, (Nb,V) (C,N), (Ti,V) (C,N), (Nb,V) N, (Ti,V)N, (Nb,Ti,V) C, (Nb,Ti,V)N. A precipitate density of the precipitate (s) is $10^{20}$ to $10^{23}$ $1/m^3$. The precipitate has an average size of 1 nm to 20 nm.

The average size of the precipitates is to be ascertained in a sample aligned at a normal angle to conveying direction. It is possible to use transmission electron microscopy (TEM) for example in order to determine the average size and/or the precipitation in their composition. The size of the precipitates is preferably determined at right angles to a cross section of the finish-rolled strip. It is particularly advantageous when, for example, in a transverse direction at right angles to the conveying direction of the finish-rolled strip, the precipitate size of the precipitates is determined in a plurality of nonoverlapping image sections in the cross section. It is also advantageous when the determination is effected in the region of a middle of the strip (based on a thickness and width of the finish-rolled strip).

Figure 8:
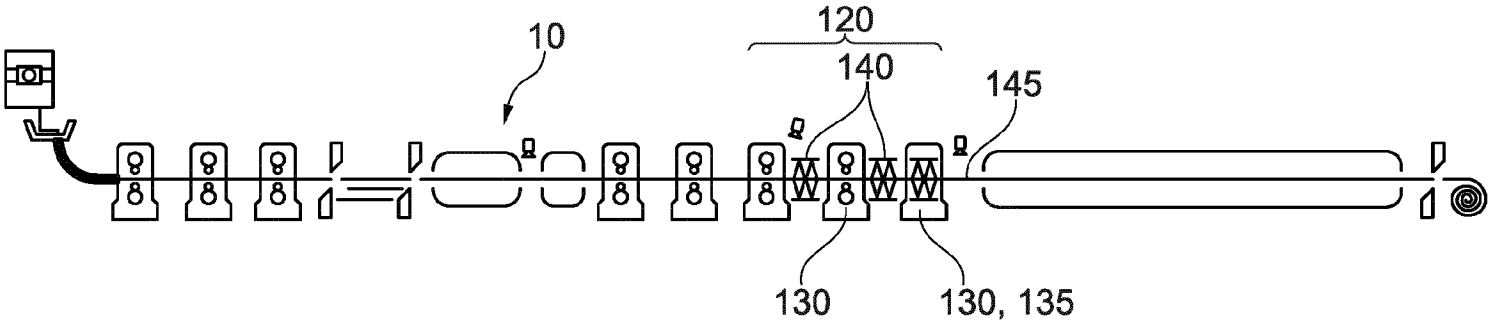
FIG. 8 a schematic diagram of an integrated casting-rolling plant in a second embodiment.

FIG. 8 shows a schematic diagram of an integrated casting-rolling plant 10 in a second embodiment.

The integrated casting-rolling plant 10 is of essentially identical design to the integrated casting-rolling plant 10 shown in FIG. 1. There follows a discussion exclusively of the differences in the integrated casting-rolling plant 10 shown in FIG. 8 with respect to the first embodiment of the integrated casting-rolling plant 10 shown in FIG. 1.

By contrast with FIG. 1, only the last second finish-rolling stand 130 of the second stand group 120 in FIG. 8 has been converted to the stand cooler 135. The second finish-rolling stand 130 upstream with respect to the finish-rolled strip 145 has not been converted and is in the form of a finish-rolling stand 130 for rolling. The two intermediate coolers 140 shown in FIG. 1 are likewise provided in FIG. 8.

The configuration shown in FIG. 8 has the advantage over FIG. 1 that only the last second finish-rolling stand 130 in conveying direction has to be converted to the stand cooler 135 in the preparation of the integrated casting-rolling plant 10 in order to perform the process described in FIG. 2. As a result, conversion work in a conventional integrated casting-rolling plant 10 is kept to a particularly low level. This configuration is suitable especially when only small amounts of the microalloyed steel are to be produced in an ESP process. By virtue of only one of the two second finish-rolling stands 130 being converted to the stand cooler 135, a retrofitting time back to the conventional construction, i.e. with five first and second finish-rolling stands 125, 130 that are capable of rolling, is particularly short.

The process described in FIG. 2 is likewise conducted with the integrated casting-rolling plant 10 shown in FIG. 8, except that, in conducting the finish-rolled strip 145 through the front second finish-rolling stand 130 of the second stand group 120 in conveying direction, no rolling of the finish-rolled strip 145 is conducted, and the second finish-rolling stand 130 instead serves merely to transport the finish-rolled strip 145. This means that the finish-rolled strip 145 is guided through the unconverted second finish-rolling stand 130 essentially while retaining its thickness. The configuration of the integrated casting-rolling plant 10 shown in FIG. 8 has the advantage that, by means of short conversion times, for example on the basis of a chemical composition of a microalloyed steel for an X60 steel, a microalloyed steel of high mechanical quality, for example X70 steel, is producible inexpensively.

LIST OF REFERENCE NUMERALS

10 integrated casting-rolling plant
15 continuous casting machine
20 prerolling train
25 first separating device
30 second separating device
35 third separating device
40 intermediate heater
45 descaler
50 finish-rolling train
55 cooling zone
60 winding device
65 control unit
70 first temperature measurement device
75 second temperature measurement device
80 third temperature measurement device
85 ladle
86 distributor
90 mold
95 metallic melt
100 thin-slab strand
105 prerolling stand
110 prerolled strip
115 first stand group
120 second stand group
125 first finish-rolling stand

130 second finish-rolling stand
135 stand cooler
140 intermediate cooler
141 upper working roll
142 lower working roll
145 finish-rolled strip
150 control device
155 data storage medium
160 interface
165 first data connection
170 second data connection
175 third data connection
180 fourth data connection
185 fifth data connection
190 sixth data connection
195 seventh data connection
200 eighth data connection
305 first process step
310 second process step
315 third process step
320 fourth process step
325 fifth process step
330 sixth process step
335 seventh process step
340 eighth process step
345 ninth process step
350 tenth process step
355 eleventh process step
360 twelfth process step
365 thirteenth process step
370 fourteenth process step
400 first graph
405 second graph
K grain size
$M_1$ martensite transformation temperature
$M_s$ martensite start temperature
$Ar_1$ ferrite-perlite transformation temperature
TS3 third target temperature
TA1 first exit temperature
TA2 second exit temperature
TA3 third exit temperature
TE1 first entrance temperature
TE2 second entrance temperature

The invention claimed is:

1. A process for producing a microalloyed steel in an integrated casting-rolling plant having a continuous casting machine having a mold, a single- or multi-stand prerolling train, a finish-rolling train having a first stand group with at least one first finish-rolling stand and a second stand group having at least one stand cooler, the process comprising:

casting a metallic melt in the mold to give a partly solidified thin-slab strand, supporting, deflecting, and cooling the partly solidified thin-slab strand to give a fully solidified thin-slab strand, rolling the fully solidified thin-slab strand with the prerolling train to give a prerolled strip, finish-rolling the prerolled strip with the first stand group of the finish-rolling train to give a finish-rolled strip, feeding, immediately after the finish rolling, the finish-rolled strip to the second stand group, and force-cooling the finish-rolled strip in the second stand group with retention of a thickness of the finish-rolled strip in such a way that a cooling rate of a core of the finish-rolled strip in the second stand group is greater than 20° C./s and less than 200° C./s, and transporting the finish-rolled strip through a cooling zone downstream of the finish-rolling train based on a conveying direction of the finish-rolled strip to a winding device downstream of the cooling zone while further cooling the finish-rolled strip, wherein the finish-rolled strip is transported with a first exit temperature (TA1) at its core into the second stand group of the finish-rolling train, wherein, upon exiting of the finish-rolled strip from the second stand group, the core of the finish-rolled strip has a second exit temperature (TA2) lower than the first exit temperature (TA1).

2. The process as claimed in claim 1, wherein the second stand group has a second finish-rolling stand, further comprising converting the second finish-rolling stand, in a preparation step prior to casting of the metallic melt, to the stand cooler by removing at least one working roll of the second finish-rolling stand and inserting at least one cooling beam into the second finish-rolling stand.

3. The process as claimed in claim 1, further comprising ascertaining with a temperature measurement device a third surface temperature with which the finish-rolled strip leaves the second stand group, wherein the force-cooling in the second stand group is controlled by open-loop/closed-loop control depending on the third surface temperature and a third target temperature (TS3) in such a way that the third surface temperature corresponds essentially to the third target temperature (TS3), wherein the third target temperature (TS3) is less than a ferrite-perlite transformation temperature ($Ar_1$).

4. The process as claimed in claim 1, wherein the cooling rate of the core of the finish-rolled strip is 20° C./s to 80° C./s, wherein the core of the finish-rolled strip is cooled continuously.

5. The process as claimed in claim 1, wherein the first exit temperature (TA1) is in a range 830° C. to 950° C., wherein the second exit temperature (TA2) is less than 700° C.

6. The process as claimed in claim 1, wherein, within a time interval of 1 second to 15 seconds after the finish-rolling of the finish-rolled strip in the first stand group, the finish-rolled strip enters the second stand group.

7. The process as claimed in claim 1, wherein forced cooling of the finish-rolled strip in the cooling zone is deactivated.

8. The process as claimed in claim 1, wherein a thickness of the prerolled strip on entry into the first stand group is 40 mm to 62 mm, wherein the first stand group reduces the thickness of the prerolled strip to that of the finish-rolled strip of 10 mm to 25 mm.

9. The process as claimed in claim 1, wherein the metallic melt is an X60 or an X70 steel melt and has a chemical composition in percent by weight of C 0.025-0.05%; Si 0.1-0.3%; Mn 0.07-1.5%, Cr<0.15%; Mo<0.2%; Nb 0.02-0.08%; Ti<0.05%; V<0.08%; N<0.008%; balance: Fe and unavoidable impurities, or wherein the metallic melt is an X80 to X120 steel melt and has a chemical composition in percent by weight of C 0.025-0.09%; Si 0.1-0.3%; Mn 0.07-2.0%, Cr<0.5%;

Mo<0.5%; Nb 0.02-0.08%; Ti<0.05%; V<0.08%; Ni<0.5%; Cu<0.4%; N<0.01%; balance: Fe and unavoidable impurities.

10. The process as claimed in claim 1, wherein a third surface temperature with which the finish-rolled strip leaves the second stand group is ascertained, wherein the forced cooling in the second stand group is controlled by open-loop/closed-loop control depending on the third surface temperature and a third target temperature (TS3) in such a way that the third surface temperature corresponds to the third target temperature (TS3), wherein the third target temperature (TS3) is less than a bainite start temperature.

11. The process as claimed in claim 1, wherein a third surface temperature with which the finish-rolled strip leaves the second stand group is ascertained, wherein the forced cooling in the second stand group is controlled by open-loop/closed-loop control depending on the third surface temperature and a third target temperature (TS3) in such a way that the third surface temperature corresponds to the third target temperature (TS3), wherein the third target temperature (TS3) is less than a martensite start temperature ($M_s$).

12. The process as claimed in claim 1, wherein the first exit temperature (TA1) is in a range 830° C. to 950° C., wherein the second exit temperature (TA2) is in a range 350° C. to 700° C.

13. The process as claimed in claim 1, wherein the first exit temperature (TA1) is in a range of 830° C. to 950° C., wherein the second exit temperature (TA2) is in a range 400° C. to 460° C.

14. The process as claimed in claim 3, further comprising ascertaining with another temperature measurement device a second surface temperature with which the finish-rolled strip leaves the first stand group, wherein the second surface temperature is also taken into account in the control of the forced cooling of the finish-rolled strip in the second stand group.

15. The process as claimed in claim 4, wherein the core of the finish-rolled strip is cooled, from the first exit temperature (TA1) to the second exit temperature (TA2) within a time interval of 2 seconds to 40 seconds.

* * * * *